US009484634B1

(12) United States Patent
Behroozi et al.

(10) Patent No.: US 9,484,634 B1
(45) Date of Patent: Nov. 1, 2016

(54) THREE DIMENSIONAL BOW TIE ANTENNA ARRAY WITH RADIATION PATTERN CONTROL FOR HIGH-ALTITUDE PLATFORMS

(71) Applicant: Google Inc., Mountain View, CA (US)

(72) Inventors: Cyrus Behroozi, Menlo Park, CA (US); Jiang Zhu, Cupertino, CA (US)

(73) Assignee: X Development LLC, Mountain View, CA (US)

( * ) Notice: Subject to any disclaimer, the term of this patent is extended or adjusted under 35 U.S.C. 154(b) by 32 days.

(21) Appl. No.: 14/727,582

(22) Filed: Jun. 1, 2015

(51) Int. Cl.

| | |
|---|---|
| ***H01Q 21/24*** | (2006.01) |
| ***H01Q 9/16*** | (2006.01) |
| ***H01Q 3/34*** | (2006.01) |
| ***H01Q 19/10*** | (2006.01) |

(52) U.S. Cl.
CPC ..... *H01Q 9/16* (2013.01); *H01Q 3/34* (2013.01); *H01Q 19/10* (2013.01); *H01Q 21/24* (2013.01)

(58) Field of Classification Search
CPC ..... H01Q 9/16; H01Q 3/34; H01Q 19/10; H01Q 21/24
USPC ..... 343/817, 818, 893
See application file for complete search history.

(56) References Cited

U.S. PATENT DOCUMENTS

| | | | | |
|---|---|---|---|---|
| 6,028,563 | A * | 2/2000 | Higgins | H01Q 1/246 343/797 |
| 6,323,821 | B1 * | 11/2001 | McLean | H01Q 1/36 343/752 |
| 6,762,730 | B2 * | 7/2004 | Schadler | H01Q 1/246 343/770 |
| 9,059,507 | B2 * | 6/2015 | Schneider | H01Q 1/1221 |

* cited by examiner

*Primary Examiner* — Brian Young
(74) *Attorney, Agent, or Firm* — McDonnell Boehnen Hulbert and Berghoff LLP

(57) ABSTRACT

This disclosure relates to an antenna system. The antenna system includes a first and a second set of radiating elements each configured to emit electromagnetic radiation corresponding to an input signal. The electromagnetic energy may be emitted by the first set may have a first polarization. The first set of radiating elements includes a first radiating element having a first height. The first set also includes a second radiating element having a second height. The second radiating element may be coupled to a first phase adjustment component. The electromagnetic energy may be emitted by the first set may have a second polarization that is perpendicular to the first polarization. The second set of radiating elements includes a third radiating element having a third height. The second set also includes a fourth radiating element having a fourth height. The fourth radiating element may be coupled to a second phase adjustment component.

20 Claims, 10 Drawing Sheets

THREE DIMENSIONAL BOW TIE ANTENNA ARRAY WITH RADIATION PATTERN CONTROL FOR HIGH-ALTITUDE PLATFORMS

BACKGROUND

Computing devices such as personal computers, laptop computers, tablet computers, cellular phones, and countless types of Internet-capable devices are increasingly prevalent in numerous aspects of modern life. As such, the demand for data connectivity via the Internet, cellular data networks, and other such networks, is growing. However, there are many areas of the world where data connectivity is still unavailable, or if available, is unreliable and/or costly. Accordingly, additional network infrastructure is desirable.

SUMMARY

In order to communicate between a ground-based system and the balloons, both the ground based system and the balloons will have antennas. The antennas are configured to both transmit and receive electromagnetic energy. Unlike networks with fixed infrastructure, the present balloon-based network features both ground-based and balloon-based components that may be able to move with respect to each other. Therefore, the presently disclosed antenna system and methods help enable communication between ground-based and balloon-based components of a network. The presently disclosed antenna system may enable the communication system to communicate over a wider range of angles than other antenna systems. By enabling communications over a wider range of angles, the presently disclosed antenna system may increase the reliability of a balloon-to-ground communication link.

In one aspect, an antenna system is disclosed. The antenna system includes a first set of radiating elements configured to emit electromagnetic radiation corresponding to an input signal. The electromagnetic energy may be emitted by the first set may have a first polarization. The first set of radiating elements includes a first radiating element having a first height. The first set also includes a second radiating element having a second height. The second radiating element may be coupled to a first phase adjustment component. The antenna system also includes a second set of radiating elements configured to emit electromagnetic radiation corresponding to the input signal. The electromagnetic energy may be emitted by the first set may have a second polarization that is substantially perpendicular to the first polarization. The second set of radiating elements includes a third radiating element having a third height. The second set also includes a fourth radiating element having a fourth height. The fourth radiating element may be coupled to a second phase adjustment component. Additionally, the antenna system includes a reflecting element configured to reflect at least a portion of the electromagnetic radiation emitted by the radiating elements. The antenna system further includes a feed configured to provide the input signal.

In a second aspect, a method of radiating electromagnetic energy is disclosed. The method includes feeding a first input signal to a signal divider configured to divide the signal into four feed signals. The method further includes offsetting the phase of a first signal of the four feed signals with a first phase offset and offsetting the phase of a second signal of the four feed signals with a second phase offset. Additionally, the method includes radiating the first signal of the four feed signals with a first radiating element. The first radiated signal may have a first polarization and a first phase. The method also includes radiating the second signal of the four feed signals with a second radiating element. The second radiated signal may have a second polarization and a second phase, where the second polarization is substantially perpendicular to the first polarization. Further, the method includes radiating a third signal of the four feed signals with a third radiating element. The third radiated signal may have the first polarization and a third phase. The method yet further includes radiating a fourth signal of the four feed signals with a fourth radiating element. The fourth radiated signal may have the second polarization and a fourth phase. Furthermore, the method includes reflecting at least a portion of the electromagnetic radiation emitted by the radiating elements via a reflecting element.

In a third aspect, another antenna system is disclosed. The antenna system includes a first set of radiating elements configured to emit electromagnetic radiation corresponding to an input signal. The first set of radiating elements may have a first height. The first set may include a first radiating element having a first polarization and a second radiating element having a second polarization. The second polarization may be substantially perpendicular to the first polarization. The antenna system may also include a second set of radiating elements configured to emit electromagnetic radiation corresponding to the input signal. The second set may have a second height. Each radiating element of the second set may be coupled to a respective phase adjustment component. The second set may include a third radiating element having a third polarization and a fourth radiating element having a fourth polarization. The third polarization may be substantially perpendicular to the fourth polarization. The antenna system may further include a reflecting element configured to reflect at least a portion of the electromagnetic radiation emitted by the radiating elements. Additionally, the antenna system may include a feed configured to provide the input signal.

In a fourth aspect, the present disclosure features an apparatus including a means for radiating electromagnetic energy. The apparatus includes means for feeding a first input signal to a signal divider configured to divide the signal into four feed signals. The apparatus further includes means for offsetting the phase of a first signal of the four feed signals with a first phase offset and means for offsetting the phase of a second signal of the four feed signals with a second phase offset. Additionally, the apparatus includes means for radiating the first signal of the four feed signals. The first radiated signal may have a first polarization and a first phase. The apparatus also includes means for radiating the second signal of the four feed signals. The second radiated signal may have a second polarization and a second phase, where the second polarization is substantially perpendicular to the first polarization. Further, the apparatus includes means for radiating a third signal of the four feed signals. The third radiated signal may have the first polarization and a third phase. The apparatus yet further includes means for radiating a fourth signal of the four feed signals. The fourth radiated signal may have the second polarization and a fourth phase. Furthermore, the apparatus includes means for reflecting at least a portion of the electromagnetic radiation emitted by the radiating elements.

DETAILED DESCRIPTION

I. Overview

Figure 1:
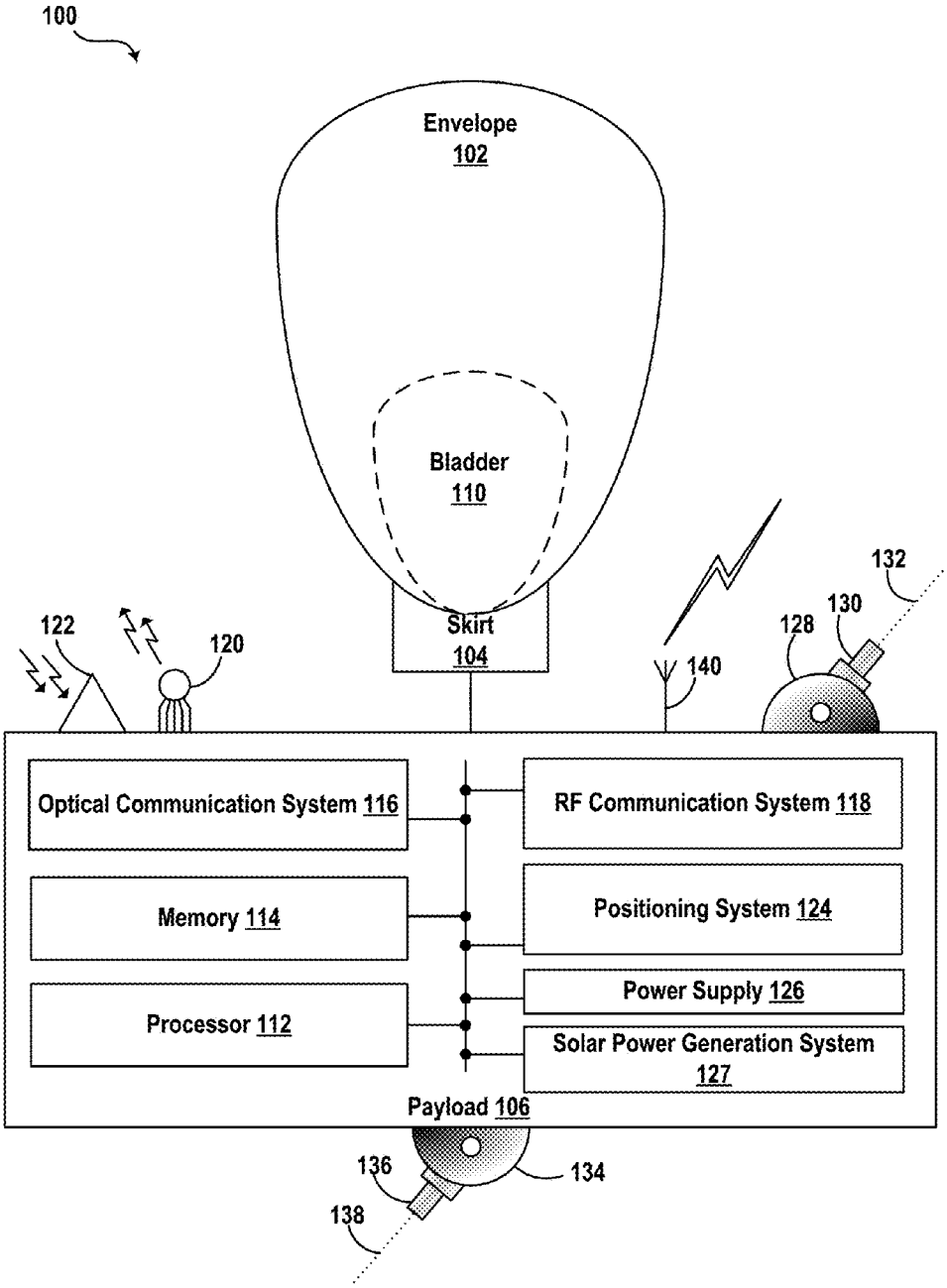
FIG. 1 illustrates a high-altitude balloon, according to an embodiment.

Illustrative embodiments can be implemented as an apparatus including or taking the form of a three dimensional bow tie antenna array with radiation pattern control for high-altitude platforms, such as a super pressure aerostatic balloon with a data network of balloons, such as, for example, a mesh network of high-altitude balloons deployed in the stratosphere. The apparatus may include a four bowtie antennas aligned for radiation pattern control that can allow both the balloon and ground-based computing system to communicate over a larger range of angles, in situations when the balloon network is needed or desired to supplement a cellular network, among other situations. The disclosed antenna design may be used on the balloon, on the ground-based receiving device, or both. The balloon network can be useful for supplementing the cellular network in various scenarios. For example, the balloon network can be a useful supplement when the cellular network has reached capacity. As another example, the balloon network can be a useful supplement when the cellular network provides insufficient coverage in a given area.

By combining four bowtie antennas in a pre-determined arrangement, an antenna unit may be created that has a radiation pattern that is desirable for communications, such as balloon-to-ground communications. A bowtie antenna has a radiation pattern that similar to the radiation pattern for a dipole antenna. The radiation pattern for a bowtie antenna may be "donut" shaped, with the maximum gain in the direction orthogonal to the axis of the antenna (i.e. axis of the current flow in the antenna). By combining multiple bowtie antennas, and adjusting various parameters of the antennas, a desired radiation pattern may be created. For example, by placing an antenna above a ground plane, energy radiated in the direction of the ground plane may be reflected by the ground plane and affect the radiation pattern. Additionally, the radiation pattern may be adjusted by having different heights for the bowtie antennas.

In one example embodiment, the four bowtie antennas may be divided into two antenna pairs. The two antennas that form the antenna pair may be aligned with the polarizations of the antennas being aligned in the same direction. Additionally, the two antennas that form the antenna pair may have different respective heights. By adjusting the height difference between the two antennas of the antenna pair, a maximum of the radiation pattern may be adjusted. In one example the radiation pattern may have a maximum at 60°. Additionally, one of the two antennas of the antenna pair may be coupled to a phase adjustment component. The phase adjustment component may be configured to offset the phase transmitted by one of the antenna elements based on the height difference of the two antennas of the antenna pair.

Furthermore, the second set of antennas may have a polarization that is perpendicular to the polarization of the first antenna pair. By having a perpendicular polarization, the two sets of antenna pairs as may have a high isolation from each other. Additionally, because of the perpendicular alignment of the antenna pairs, the antenna system may be able to transmit and receive signals regardless of the polarization and alignment of the receiving device. All four antennas of the presently disclosed system may be fed with one common antenna feed. Because all the antennas are fed with a common feed, the far field radiation pattern maybe the sum of the radiation pattern of each individual element. Thus, based on the size, shape, and location of the four antenna elements, the system radiation pattern may be adjusted. In various embodiments, the far-field radiation pattern may be adjusted in a way to allow communications in a balloon-to-ground communication system to function over a wide range of angles between the balloon and the ground-based receiver. In a further embodiment, the far-field radiation pattern may be adjusted in a way to compensate for a weaker received signal when the balloon is not directly over the ground-based receiver. In other embodiments, different far-field radiation patterns may be created based on a design criteria.

However, this disclosure is not limited to a network of balloons and similar methods and apparatuses. The disclosed methods and apparatuses may also function with a single balloon, a high-altitude platform, or other variable-buoyancy vehicles, such as submarines. Additionally, a similar configure may be created with more or fewer antennas.

II. Balloon Configuration

FIG. 1 illustrates a high-altitude balloon 100, according to an embodiment. The balloon 100 includes an envelope 102, a skirt 104, and a payload 106.

The envelope 102 and the skirt 104 can take various forms, which can be currently well-known or yet to be developed. For instance, the envelope 102, the skirt 104, or both can be made of metalized Mylar® or BoPET (biaxially-oriented polyethylene terephthalate). Some or all of the envelope 102, the skirt 104, or both can be constructed from a highly-flexible latex material or a rubber material, such as, for example, chloroprene. These examples are illustrative only; other materials can be used as well. Further, the shape and size of the envelope 102 and the skirt 104 can vary depending upon the particular implementation. Additionally, the envelope 102 can be filled with various different types of gases, such as, for example, helium, hydrogen, or both. These examples are illustrative only; other types of gases can be used as well.

The payload 106 of the balloon 100 includes a processor 112 and memory 114. The memory 114 can be or include a non-transitory computer-readable medium. The non-transitory computer-readable medium can have instructions stored thereon, which can be accessed and executed by the processor 112 in order to carry out some or all of the functions provided in this disclosure.

The payload 106 of the balloon 100 can also include various other types of equipment and systems to provide a number of different functions. For example, the payload 106 includes an optical communication system 116. The optical communication system 116 can transmit optical signals by way of an ultra-bright LED system 120. In addition, the optical communication system 116 can receive optical signals by way of an optical-communication receiver, such as, for example, a photo-diode receiver system. Further, the payload 106 can include an RF communication system 118. The RF communication system 118 can transmit and/or receive RF communications by way of an antenna system 140.

In addition, the payload 106 includes a power supply 126. The power supply 126 can be used to provide power to the various components of the balloon 100. The power supply 126 can be or include a rechargeable battery. In some implementations, the power supply 126 can represent another suitable power supply known in the art for producing power. In addition, the balloon 100 includes a solar power generation system 127. The solar power generation system 127 can include solar panels, which can be used to generate power for charging the power supply 126 or for distribution by the power supply 126. In some embodiments, it may be desirable for the balloon system to run off sustainable power. Therefore, all energy used by the balloon system from power supply 126 may be provided from a renewable source, such as solar power generation system 127.

Further, the payload 106 includes various types of sensors 128. The payload 106 can include sensors such as, for example, video or still cameras, a GPS system, motion sensors, accelerometers, gyroscopes, compasses, or sensors for capturing environmental data. These examples are illustrative only; the payload 106 can include various other types of sensors. Further, some or all of the components in the payload 106 can be implemented in a radiosonde, which can be operable to measure various types of information, such as, for example, pressure, altitude, geographical position (latitude and longitude), temperature, relative humidity, wind speed, or direction, among other information.

As noted above, the payload 106 includes an ultra-bright LED system 120. In some implementations, the ultra-bright LED system 120 can be used for free-space optical communication with other balloons. In some implementations, the ultra-bright LED system 120 can be used for free-space optical communication with satellites. In some implementations, the ultra-bright LED system 120 can be used for free-space optical communication both with other balloons and with satellites. To this end, the optical communication system 116 can be configured to transmit a free-space optical signal by causing modulations in the ultra-bright LED system 120. The manner in which the optical communication system 116 is implemented can vary, depending upon the particular application.

In addition, the balloon 100 can be configured for altitude control. For instance, the balloon 100 can include a variable buoyancy system. The buoyancy system can be configured to change the altitude of the balloon 100 by adjusting the volume, the density, or both of the gas in the envelope 102 of the balloon 100. A variable buoyancy system can take various forms, and can generally be any system that can change the volume and/or density of gas in the envelope 102 of the balloon 100.

In an embodiment, a variable buoyancy system can include a bladder 110 that is located inside of the envelope 102. The bladder 110 can be an elastic chamber that is configured to hold liquid and/or gas. Alternatively, the bladder 110 need not be inside the envelope 102. For instance, the bladder 110 can be a rigid bladder that can be pressurized well beyond neutral pressure. The buoyancy of the balloon 100 can therefore be adjusted by changing the density and/or volume of the gas in the bladder 110. To change the density in the bladder 110, the balloon 100 can be configured with systems and/or mechanisms for heating and/or cooling the gas in the bladder 110. Further, to change the volume, the balloon 100 can include pumps or other features for adding gas to and/or removing gas from the bladder 110. To change the volume of the bladder 110, the balloon 100 can include release valves or other features that are controllable to allow gas to escape from the bladder 110. Multiple bladders 110 can be implemented within the scope of this disclosure. For instance, multiple bladders can be used to improve balloon stability.

In an embodiment, the envelope 102 can be filled with helium, hydrogen, or other material that is lighter than air. Thus, the envelope 102 can have an associated upward buoyancy force. In this embodiment, air in the bladder 110 can be considered a ballast tank that can have an associated downward ballast force. In another embodiment, the amount of air in the bladder 110 can be changed by pumping air (for example, with an air compressor) into and out of the bladder 110. By adjusting the amount of air in the bladder 110, the ballast force can be controlled. In some embodiments, the ballast force can be used, in part, to counteract the buoyancy force and/or to provide altitude stability.

In some embodiments, the envelope 102 can be substantially rigid and include an enclosed volume. Air can be evacuated from the envelope 102 while the enclosed volume is substantially maintained. In other words, at least a partial vacuum can be created and maintained within the enclosed volume. Thus, the envelope 102 and the enclosed volume can become lighter than air and provide a buoyancy force. In some embodiments, air or another material can be controllably introduced into the partial vacuum of the enclosed volume by a control unit in an effort to adjust the overall buoyancy force and/or to provide altitude control. Further, the envelope 102 may be coupled to a mass-changing unit, configured to function as the control unit. The mass-changing unit may be configured with an impeller configured to add or remove air from within the envelope 102. Additionally, the mass-changing unit may also include a vent configured to add or remove air from the envelope 102. A more detailed description of the altitude control system is described with respect to FIG. 5 herein.

In an embodiment, a portion of the envelope 102 can be a first color (for example, black) and/or a first material that is different from another portion or the remainder of the envelope 102. The other portion or the remainder of the envelope can have a second color (for example, white) and/or a second material. For instance, the first color and/or first material can be configured to absorb a relatively larger amount of solar energy than the second color and/or second material. Thus, rotating the balloon such that the first material is facing the sun can act to heat the envelope 102 as well as the gas inside the envelope 102. In this way, the buoyancy force of the envelope 102 can increase. By rotating the balloon such that the second material is facing the sun, the temperature of gas inside the envelope 102 can decrease. Accordingly, the buoyancy force can decrease. In this manner, the buoyancy force of the balloon can be adjusted by changing the temperature/volume of gas inside the envelope 102 using solar energy. In this embodiment, a bladder need not be an element of the balloon 100. Thus, in this embodiment, altitude control of the balloon 100 can be achieved, at least in part, by adjusting the rotation of the balloon 100 with respect to the sun.

Further, the payload 106 of the balloon 100 can include a navigation system (not shown in FIG. 1). The navigation system can implement station-keeping functions to maintain position within and/or move to a position in accordance with a desired topology. In particular, the navigation system can use altitudinal wind data to determine altitudinal adjustments that result in the wind carrying the balloon in a desired direction and/or to a desired location. The altitude-control system can then make adjustments to the density of the balloon chamber in order to effectuate the determined altitudinal adjustments and cause the balloon to move laterally to the desired direction and/or to the desired location.

Alternatively, the altitudinal adjustments can be computed by a ground-based control system and communicated to the high-altitude balloon. As another alternative, the altitudinal adjustments can be computed by a ground-based or satellite-based control system and communicated to the high-altitude balloon. Furthermore, in some embodiments, specific balloons in a heterogeneous balloon network can be configured to compute altitudinal adjustments for other balloons and transmit the adjustment commands to those other balloons.

In such an arrangement, the navigation system can be operable to navigate the balloon to a landing location, in the event the balloon needs to be removed from the network and/or accessed on the ground. Further, a balloon can be self-sustaining so that it does not need to be accessed on the ground. In some embodiments, a balloon can be serviced in-flight by one or more service balloons or by another type of service aerostat or service aircraft.

III. Balloon Networks

Figure 2:
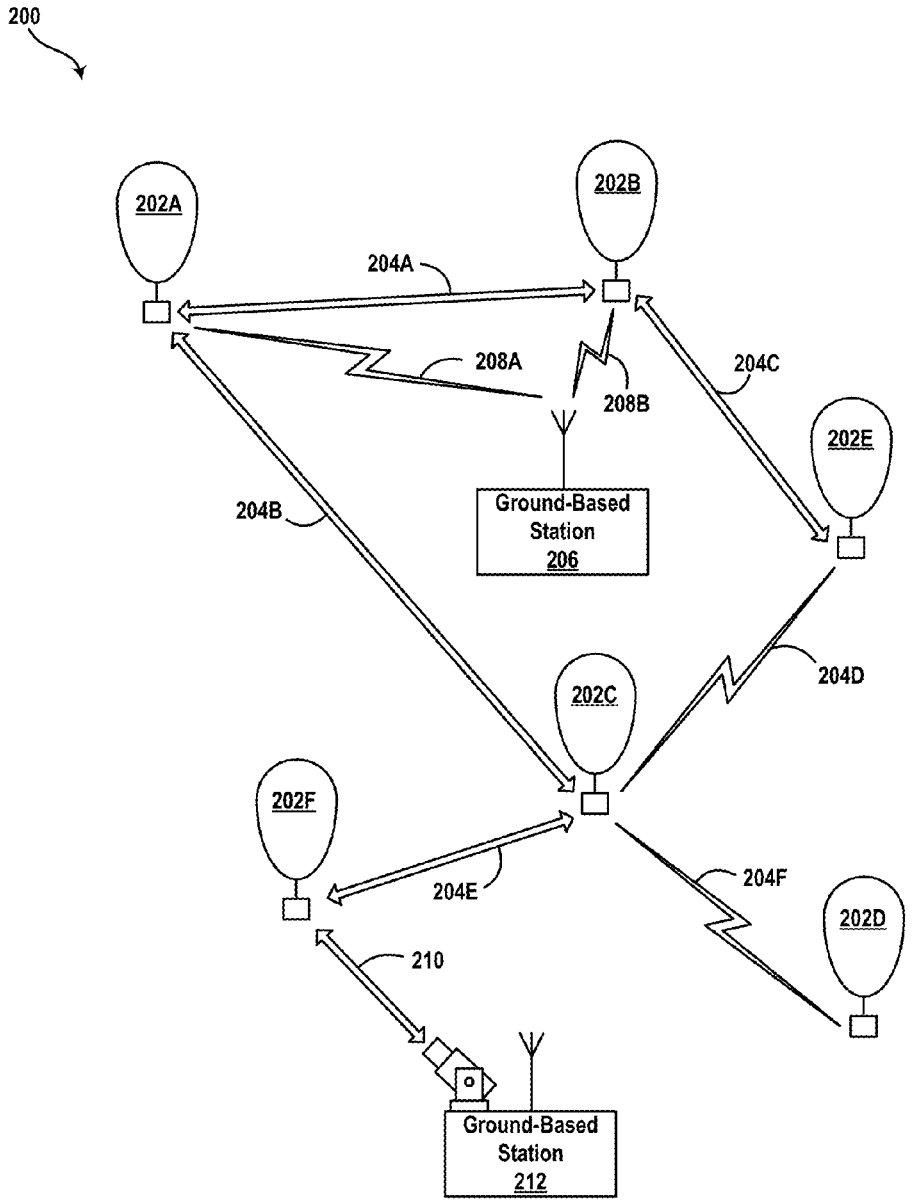
FIG. 2 illustrates a balloon network, according to an embodiment.

FIG. 2 illustrates a balloon network 200, according to an embodiment. The balloon network 200 includes balloons 202A-202F. The balloons 202A-202F are configured to communicate with one another by way of free-space optical links 204A-204F. Configured as such, the balloons 202A to 202F can collectively function as a mesh network for packet-data communications. Further, at least some of the balloons 202A-202F, such as, for example, the balloons 202A and 202B, can be configured for RF communications with a ground-based station 206 by way of respective RF links 208A and 208B. The ground-based station 206 represents one or more ground-based stations. In addition, some of the balloons 202A-202F, such as, for example, the balloon 202F, can be configured to communicate by way of an optical link 210 with a ground-based station 212. The ground-based station 212 represents one or more ground-based stations.

In an embodiment, the balloons 202A-202F are high-altitude balloons, which can be deployed in the stratosphere. At moderate latitudes, the stratosphere includes altitudes between approximately 10 kilometers (km) and 50 km above the Earth's surface. At the poles, the stratosphere starts at an altitude of approximately 8 km. In an embodiment, high-altitude balloons can be configured to operate in an altitude range within the stratosphere that has relatively low wind-speeds, such as, for example, between 5 and 20 miles per hour (mph).

In the high-altitude-balloon network 200, the balloons 202A-202F can be configured to operate at altitudes between 18 km and 25 km. In some implementations, the balloons 202A-202F can be configured to operate at other altitudes. The altitude range of 18 km—25 km can be advantageous for several reasons. In particular, this layer of the stratosphere generally has relatively low wind speeds (for example, winds between 5 and 20 mph) and relatively little turbulence. Further, while the winds in this altitude range can vary with latitude and by season, the variations can be modeled in a reasonably accurate manner. In addition, altitudes above 18 km are typically above the maximum flight level designated for commercial air traffic. Therefore, interference with commercial flights is not a significant concern when balloons are deployed between 18 km and 25 km.

To transmit data to another balloon, a given balloon 202A-202F can be configured to transmit an optical signal by way of a corresponding optical link 204A-204F. In an embodiment, some or all of the balloons 202A-202F can use one or more high-power light-emitting diodes (LEDs) to transmit an optical signal. Alternatively, some or all of the balloons 202A-202F can include laser systems for free-space optical communications over corresponding optical links 204A-204F. Other types of free-space optical communication are possible. Further, in order to receive an optical signal from another balloon by way of an optical link, a given balloon 202A-202F can include one or more optical receivers, as discussed above in connection with FIG. 1.

The balloons 202A-202F can utilize one or more of various different RF air-interface protocols for communication with ground-based stations, such as, for example, the ground-based station 206. For instance, some or all of the balloons 202A-202F can be configured to communicate with the ground-based station 206 using protocols described in IEEE 802.11 (including any of the IEEE 802.11 revisions), various cellular protocols such as GSM, CDMA, UMTS, EV-DO, WiMAX, and/or LTE, and/or one or more appropriate protocols developed for balloon-ground RF communication, among other possibilities.

There can be scenarios where the RF links 208A-208B do not provide a desired link capacity for balloon-ground communications. For instance, increased capacity can be desirable to provide backhaul links from a ground-based gateway. Accordingly, a balloon network can also include downlink balloons, which can provide a high-capacity air-ground link.

For example, in the balloon network 200, the balloon 202F is configured as a downlink balloon. Like other balloons in the balloon network 200, the downlink balloon 202F can be operable for optical communication with other balloons by way of corresponding optical links 204A-204F. The downlink balloon 202F can also be configured for free-space optical communication with the ground-based station 212 by way of the optical link 210. The optical link 210 can therefore serve as a high-capacity link (as compared to the RF links 208A-208B) between the balloon network 200 and the ground-based station 212.

Note that in some implementations, the downlink balloon 202F can be operable for RF communication with the ground-based stations 206. In other implementations, the downlink balloon 202F may only use the optical link 210 for balloon-to-ground communications. Further, while the arrangement shown in FIG. 2 includes one downlink balloon 202F, a balloon network can also include multiple downlink balloons. In addition, a balloon network can be implemented without the use of any downlink balloons.

In some implementations, a downlink balloon can be equipped with a specialized, high-bandwidth RF communication system for balloon-to-ground communications, instead of, or in addition to, a free-space optical communication system. The high-bandwidth RF communication system can take the form of an ultra-wideband system, which can provide an RF link with substantially the same capacity as one of the optical links 204A-204F.

Ground-based stations, such as the ground-based stations 206 and 212, can take various forms. Generally, a ground-based station includes components such as transceivers, transmitters, and receivers for communication with a balloon network by way of RF links, optical links, or both.

Further, a ground-based station can use various air-interface protocols in order to communicate with one or more of the balloons 202A-202F by way of an RF link. As such, a ground-based station 206 can be configured as an access point by which various devices can connect to the balloon network 200. The ground-based station 206 can have other configurations and can serve other purposes without departing from the scope of this disclosure.

Some or all of the balloons 202A-202F can be configured to establish a communication link with space-based satellites by way of corresponding communication links. The balloons can establish the communication links with the space-based satellites in addition to, or as an alternative to, the ground-based communication links. In addition, the balloons can be configured to communicate with the space-based satellites using any suitable protocol. In some implementations, one or more of the communication links can be optical links. Accordingly, one or more of the balloons can communicate with the satellites by way of free-space optical communication. Other balloon-satellite communication links and techniques can be used.

Further, some ground-based stations, such as, for example, the ground-based station 206, can be configured as gateways between the balloon network 200 and another network. For example, the ground-based station 206 can serve as an interface between the balloon network 200 and the Internet, a cellular service provider's network, or another network.

A. Mesh-Network Functionality

As noted above, the balloons 202A-202F can collectively function as a mesh network. More specifically, because the balloons 202A-202F can communicate with one another using free-space optical links, the balloons can collectively function as a free-space optical mesh network.

In a mesh-network configuration, each of the balloons 202A-202F can function as a node of the mesh network. The mesh network can be operable to receive data directed to it and to route data to other balloons. As such, data can be routed from a source balloon to a destination balloon by determining an appropriate sequence of optical links between the source balloon and the destination balloon. This disclosure may refer to these optical links, collectively, as a "lightpath" for the connection between the source and destination balloons. Further, this disclosure may refer to each of the optical links as a "hop" along the lightpath.

To operate as a mesh network, the balloons 202A-202F can employ various routing techniques and self-healing algorithms. In some implementations, the balloon network 200 can employ adaptive or dynamic routing, in which a lightpath between a source balloon and a destination balloon is determined and set-up when the connection is needed, and is released at a later time. Further, when adaptive routing is used, the lightpath can be determined dynamically, depending upon the current state, past state, and/or predicted state of the balloon network.

In addition, the network topology can change as the balloons 202A-202F move relative to one another and/or relative to the ground. Accordingly, the balloon network 200 can apply a mesh protocol to update the state of the network as the topology of the network changes. For example, to address the mobility of the balloons 202A-202F, the balloon network 200 can employ and/or adapt various techniques that are employed in mobile ad hoc networks (MANETs).

In some implementations, the balloon network 200 can be configured as a transparent mesh network. In a transparent balloon network, the balloons can include components for physical switching in a way that is entirely optical, without involving a substantial number of, or any, electrical components in the physical routing of optical signals. Accordingly, in a transparent configuration with optical switching, signals can travel through a multi-hop lightpath that is entirely optical.

In other implementations, the balloon network 200 can implement a free-space optical mesh network that is opaque. In an opaque configuration, some or all of the balloons 202A-202F can implement optical-electrical-optical (OEO) switching. For example, some or all of the balloons 202A-202F can include optical cross-connects (OXCs) for OEO conversion of optical signals. This example is illustrative only; other opaque configurations can be used.

The balloons 202A-202F in the balloon network 200 can utilize techniques such as wavelength division multiplexing (WDM) in order to increase link capacity. When WDM is implemented with transparent switching, physical lightpaths through the balloon network can be subject to the wavelength continuity constraint. In particular, because switching in a transparent network is entirely optical, it can be necessary, in some instances, to assign the same wavelength to all optical links along a given lightpath.

An opaque configuration can be used to avoid the wavelength continuity constraint. In particular, balloons in an opaque balloon network can include OEO switching systems operable for wavelength conversion. As a result, balloons can convert the wavelength of an optical signal at corresponding hops along a lightpath.

Further, various routing algorithms can be employed in an opaque configuration. For example, to determine a primary lightpath and/or one or more diverse backup lightpaths for a given connection, a balloon can apply shortest-path routing techniques, such as, for example, Dijkstra's algorithm and k-shortest path. In addition, a balloon can apply edge and node-diverse or disjoint routing, such as, for example, Suurballe's algorithm. Further, a technique for maintaining a particular quality of service (QoS) can be employed when determining a lightpath.

B. Station-Keeping Functionality

In an embodiment, a balloon network 100 can implement station-keeping functions to help provide a desired network topology. For example, station-keeping can involve each of the balloons 202A-202F maintaining a position or moving to a position relative to one or more other balloons in the network 200. The station-keeping can also, or instead, involve each of the balloons 202A-202F maintaining a position or moving to a position relative to the ground. Each of the balloons 202A-202F can implement station-keeping functions to determine the given balloon's desired positioning in the desired topology, and if desirable, to determine how the given balloon is to move to the desired position.

The network topology can vary depending on the desired implementation. In an implementation, the balloons 202A-202F can implement station-keeping such that the balloon network 200 has a substantially uniform topology. For example, a given balloon can implement station-keeping functions to position itself at substantially the same distance (or within a certain range of distances) from adjacent balloons in the balloon network. In another implementation, the balloons 202A-202F can implement station-keeping such that the balloon network 200 has a substantially non-uniform topology. This implementation can be useful when there is a need for balloons to be distributed more densely in some areas than in others. For example, to help meet higher bandwidth demands that are typical in urban areas, balloons can be clustered more densely over urban areas than in other areas. For similar reasons, the distribution of balloons can be denser over land than over large bodies of water. These examples are illustrative only; non-uniform topologies can be used in other settings.

In addition, the topology of a balloon network can be adaptable. In particular, balloons can utilize station-keeping functionality to allow the balloons to adjust their respective positioning in accordance with a change in the topology of the network. For example, several balloons can move to new positions in order to change a balloon density in a given area.

In an implementation, the balloon network 200 can employ an energy function to determine whether balloons should move in order to provide a desired topology. In addition, the energy function can indicate how the balloons should move in order to provide the desired topology. In particular, a state of a given balloon and states of some or all nearby balloons can be used as inputs to an energy function. The energy function can apply the states to a desired network state, which can be a state corresponding to the desired topology. A vector indicating a desired movement of the given balloon can then be determined by determining a gradient of the energy function. The given balloon can then determine appropriate actions to take in order to effectuate the desired movement. For example, a balloon can determine an altitude adjustment or adjustments such that winds will move the balloon in the desired manner.

IV. A Three Dimensional Bow Tie Antenna Array

The three dimensional bow tie antenna array disclosed herein may be used on a balloon, on a ground-based receiving device, or both. In some examples, the geometry of the bowtie antenna may be different depending on the embodiment. However, the general structure of the antenna may be similar to that described. In one example embodiment, the bowtie antennas may be configured to communicate between a balloon-based device and a ground-based device over a wireless link having a frequency between 700 and 960 megahertz (MHz). The antenna system may also have a fractional bandwidth of approximately 30% and a peak gain at 60°. The antennas of the present disclosure may be adapted for use with other frequencies as well. One skilled in the art would understand how to scale the antennas to other frequencies.

Figure 3A:
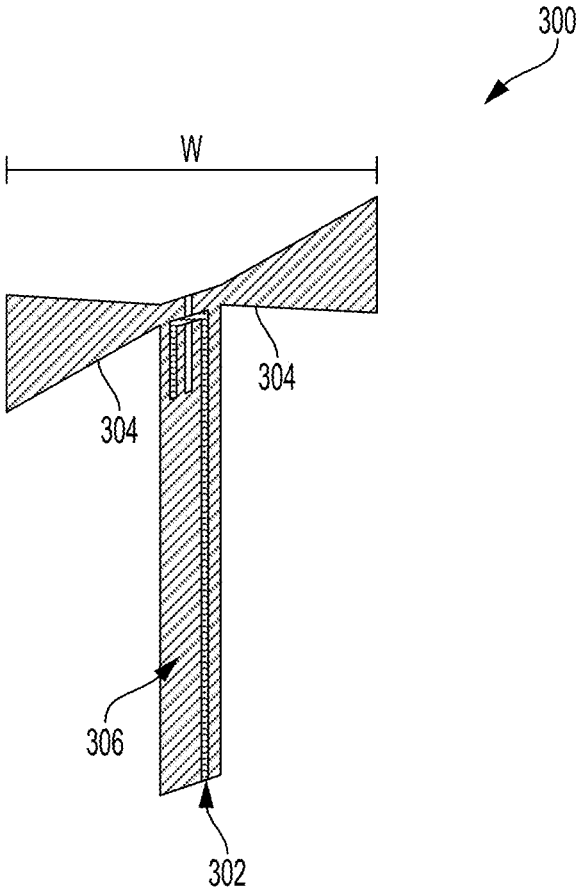
FIG. 3A illustrates an example bowtie antenna.

FIG. 3A illustrates an isometric view of an example bowtie antenna 300 for radiation pattern control. The bowtie antenna 300 may be configured with a feed 302. The feed 302 may be configured to couple a signal from an input (not shown) to the arms 304 of the bowtie antenna 300. The feed may also be configured to couple a signal received by the bowtie antenna 300 as well. The arms 304 of the bowtie antenna 300 have a width W. The width W may be based on a frequency of operation of the bowtie antenna 300. Additionally, the bowtie antenna 300 may also have a stem 306 that has an associated height.

Figure 3B:
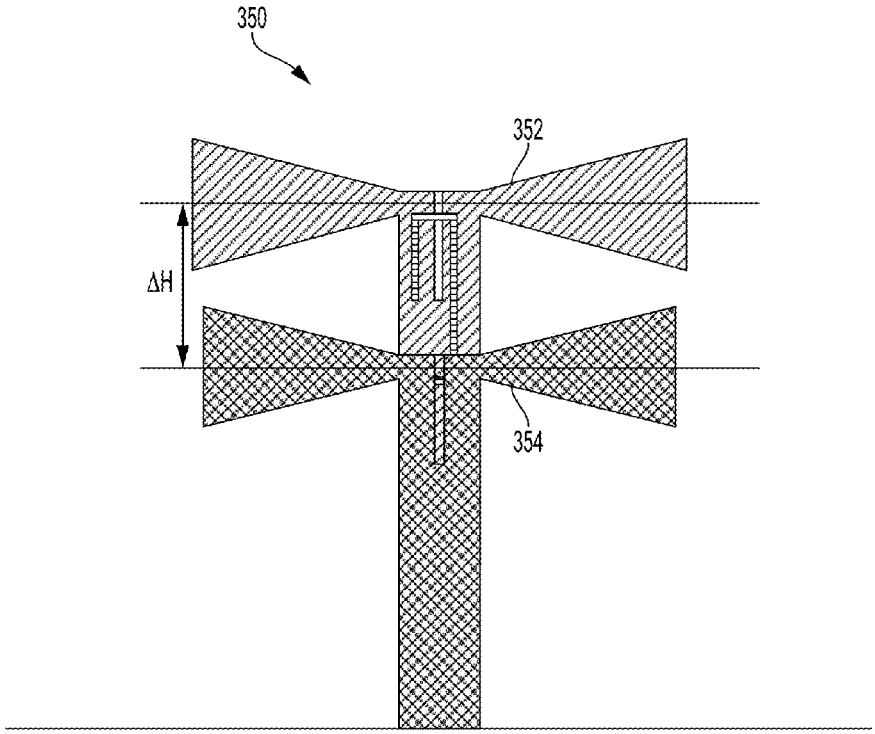
FIG. 3B illustrates an example bowtie antenna pair.

FIG. 3B illustrates an example bowtie antenna pair 350. The two antennas 352 and 354 that form the antenna pair 350 may each be similar to the previously described bowtie antenna of FIG. 3A. Additionally, the two antennas 352 and 354 that form the antenna pair 350 may have a height difference, shown in FIG. 3B as $\hat{x}$H. Thus, the length of the stem (306 of FIG. 3A), may be different for each of antenna 352 and 354. Because the length of the stem is different for each antenna, the phase of the signal transmitted by each respective antenna may be different. In order to have the same phase transmitted by the two antennas, a phase adjustment component may be added to the antenna system to offset the height difference $\hat{x}$H.

Figure 4A:
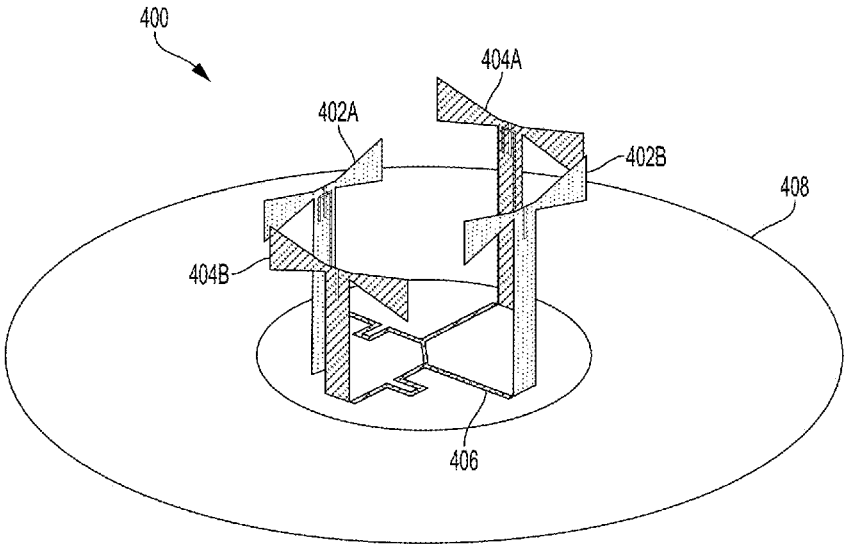
FIG. 4A illustrates an example antenna system.

FIG. 4A illustrates an example antenna system 400. The configuration shown in FIG. 4A is one example layout for the four bowtie antennas. As shown in FIG. 4A, the example antenna system 400 has a first antenna pair 402A, 402B and a second antenna pair 404A, 404B. The first antenna pair 402A, 402B and the second antenna pair 404A, 404B may be oriented so the antenna pairs are perpendicular to one another. Both antenna pairs may be coupled to a feed network 406. The feed network 406 may be configured to supply an electromagnetic signal to each antenna. Additionally, FIG. 4A includes a metallic ground plane 408. The metallic ground plane 408 is configured to reflect electromagnetic radiation transmitted by antennas from both the first antenna pair 402A, 402B and the second antenna pair 404A, 404B.

Figure 4B:
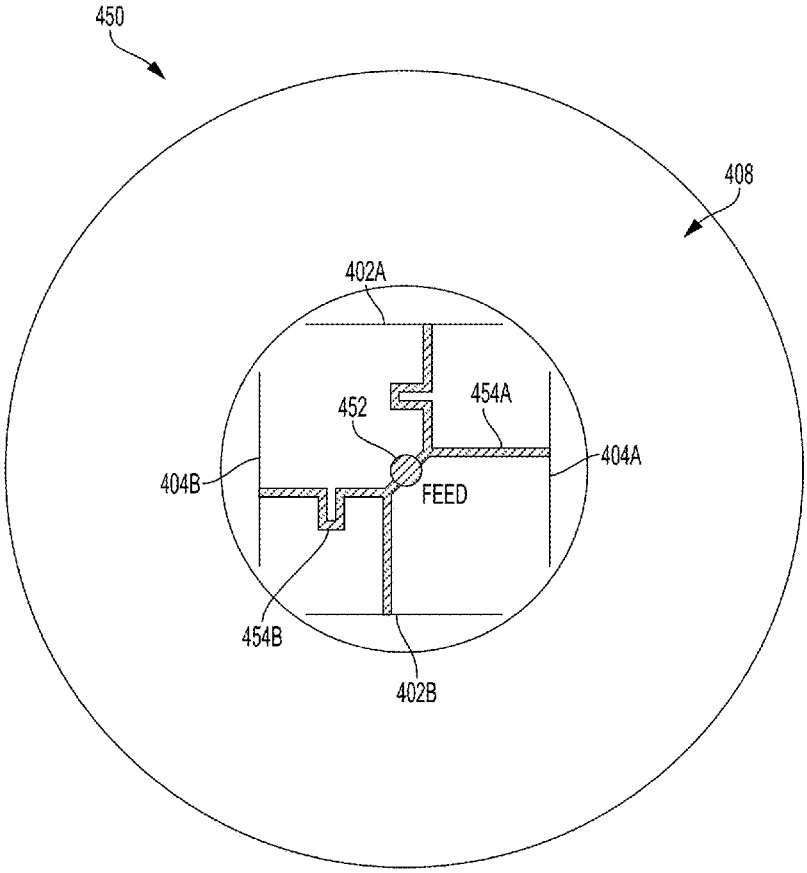
FIG. 4B illustrates a top view of an example antenna system.

FIG. 4B illustrates a top view of an example antenna system 450. The configuration shown in FIG. 4B may be a top view of the configuration shown in FIG. 4A. As shown in FIG. 4B, the example antenna system 450 has a first antenna pair 402A, 402B and a second antenna pair 404A, 404B. As previously discussed, the first antenna pair 402A, 402B and the second antenna pair 404A, 404B may be oriented so the antenna pairs are perpendicular to one another. Additionally, FIG. 4B includes a metallic ground plane 408. The metallic ground plane 408 is configured to reflect electromagnetic radiation transmitted by antennas from both the first antenna pair 402A, 402B and the second antenna pair 404A, 404B.

Both antenna pairs may be coupled to a feed network that has a feed 452 configured to supply a signal for the antennas to transmit. The feed network also can couple received signals from the antenna back to the feed 452. As shown in FIG. 4B, the feed network may have different path lengths. A first feed line 454A may take a straight path from the feed 452 to the respective antenna 404A. The second feed line 454B may have a phase-adjustment section that increases the path length of the second feed line 454B for the signal that feeds antenna 404B. The phase-adjustment section may be created to offset for a height difference between the two antennas of the respective antenna pair. For example, the phase-adjustment section may add a phase offset equal to the phase change a signal would go through if the antennas were the same height. In on specific example, the path distance (or phase offset) of the phase-adjustment section may be equal to $\hat{x}$H. Additionally, each antenna pair may have one antenna feed by a feed line that has a phase adjustment component. In some examples, the phase adjustment component may be a discrete component rather than an increase in the path length.

Figure 5:
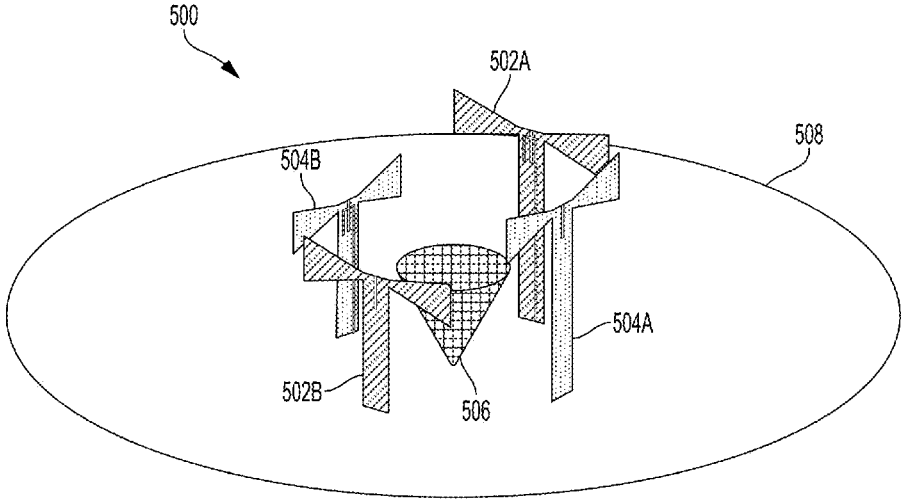
FIG. 5 illustrates an example antenna system.

FIG. 5 illustrates an example antenna system 500. Similar to previous figures, the example antenna system 500 has a first antenna pair 502A, 502B and a second antenna pair 504A, 504B. Each of the four bowtie antennas 502A, 502B, 504A, 504B may be bowtie antennas similar to those previously described. The example antenna system 500 also includes a cone antenna 506. The cone antenna 506 may radiate the signal from the feed with a vertical polarization. In some examples, cone antenna 506 may be replaced with another antenna, such as a monopole, that provides a vertical polarization. Thus, the cone antenna 506 may radiate a signal that has a polarization perpendicular to the polarization radiated by each of the bowtie antennas. The four bowtie antennas 502A, 502B, 504A, 504B may radiate signals with a horizontal polarization. The example antenna system 500 may also have a ground plane 508 configured to reflect radiated signals.

One antenna from each antenna pair (502A and 504A) may be "tall" antennas that have a first height. Further, one antenna from each antenna pair (502B and 504B) may be "short" antennas that have a second height. As shown in FIG. 5, both "tall" antennas and both "short" antennas may have the same height. However, in other examples, the "tall" antennas may have different heights than each other and the "short" antennas may have different heights as well.

The various views of the example three dimensional bow tie antenna array shown in FIGS. 5-5 show example geometries for use with disclosed embodiments. The size, shape, and location of the various elements of the three dimensional bow tie antenna array may be adjusted based on design criteria of a specific antenna system. For example, changing the ΔH of a respective antenna pair may change the angle at which a radiation pattern has a maximum. Thus, the resulting radiation pattern may change based on the height difference between antennas of an antenna pair. Additionally, the distance between the various antennas may be adjusted as well. Further examples will be discussed below.

In one example, the first antenna may have a height of 100 millimeters (mm) and the second antenna may have a height of 145 mm. Thus, in this example, the ΔH may be 45 mm. Additionally, in this example, the first antenna may have a width, W, of 130 mm. The second antenna may have a width, W, of 136 mm. The ends of the bowtie antenna may be 35 mm wide for the first antenna and 36 mm wide for the second antenna. Yet further, the phase-shifting element may be configured to provide an 81-degree phase shift at 800 MHz. The foregoing was one example, dimensions may be varied based on the specific design criteria.

Figure 6:
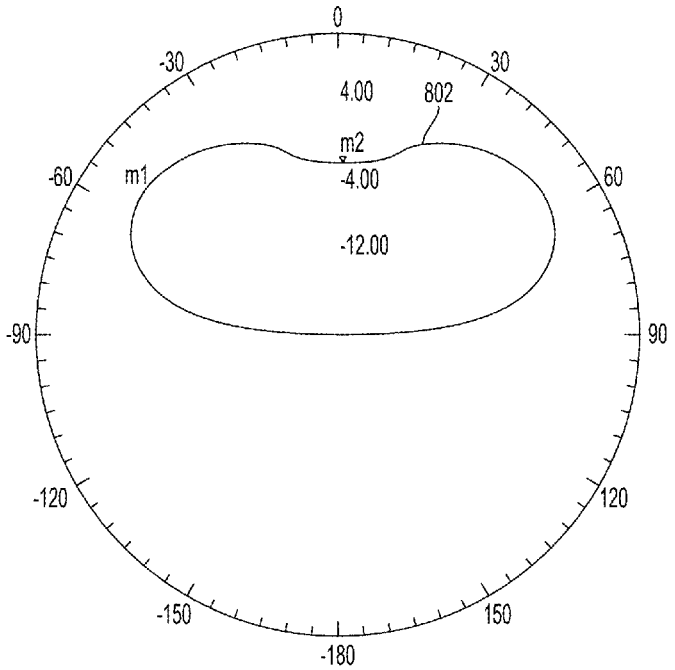
FIG. 6 illustrates an example radiation pattern for an example antenna system.

FIG. 6 illustrates an example radiation pattern for an example three dimensional bow tie antenna array. A three dimensional bow tie antenna array—such as those described with respect to FIGS. 4A, 4B, and 5—may have a radiation pattern similar to that shown in FIG. 6. The three dimensional bow tie antenna array may have a relative minimum in a direction normal to the surface of the ground plane (i.e. when theta is equal to 0 degrees) and a maximum of the antenna radiation pattern may be at approximately when theta is equal to ±60 degrees. In other examples, the maximum of the antenna may be at angles other than ±60 degrees. In this example, the maximum and relative minimum may be selected in a way to offset for the increase in distance (and thus, weaker received signal) between the balloon and the ground-based antenna as the balloon changes angle with respect to the ground-based antenna. Additionally, when the ΔH of a respective antenna pair is changed, the angle at which the maximum is located may change as well.

To operate the antennas a method of radiating electromagnetic energy from the three dimensional bow tie antenna array may be used. The method includes feeding a first input signal to a signal divider configured to divide the signal into four feed signals. Because each antenna is fed based on a common feed, the far-field radiation pattern may be sum of the radiation pattern for each individual antenna. The method further includes offsetting the phase of a first signal of the four feed signals with a first phase offset and offsetting the phase of a second signal of the four feed signals with a second phase offset. The phase offsets for the respective signals is based on a height difference between the two antennas of the respective antenna pair. The phase offset may correspond to the phase of the transmitted signal if the two antennas were the same height. For example, the phase adjustment may be equal to the phase offset as if the signal would propagate over the distance ΔH.

Additionally, the method includes radiating the first signal of the four feed signals with a first radiating element. The first radiated signal may have a first polarization and a first phase. The polarization of the radiating element may be aligned in the direction of the electrical current on the radiating element. For bowtie antennas, the polarization is substantially aligned with the axis of the antenna. As shown in FIG. 5A, the polarization of the bowtie antenna may be horizontally polarized.

The method also includes radiating the second signal of the four feed signals with a second radiating element. The second radiated signal may have a second polarization and a second phase, where the second polarization is substantially perpendicular to the first polarization. For example, the second radiating element may also be a bowtie antenna. Although the second radiating element may also have a horizontal polarization, the polarization may be perpendicular to the first polarization while still being in the same horizontal plane.

Further, the method includes radiating a third signal of the four feed signals with a third radiating element. The third radiated signal may have the first polarization and a third phase. Thus, the polarization of the first and third radiating elements may be substantially similar (i.e. parallel polarization).

The method yet further includes radiating a fourth signal of the four feed signals with a fourth radiating element. The fourth radiated signal may have the second polarization and a fourth phase. Thus, the polarization of the second and fourth radiating elements may be substantially similar (i.e. parallel polarization).

Furthermore, the method includes reflecting at least a portion of the electromagnetic radiation emitted by the radiating elements via a reflecting element. The reflecting element may be a ground plane that is aligned in the same horizontal plane as the polarization of the four bowtie antennas.

As disclosed herein is an antenna system for use between two devices that may have a movement relative to one another, for example a ground-based computing system in communication with a balloon-based device. The antenna system may combine (i) four bowtie antennas configured in two antenna pairs and (ii) a phase offset applied to one antenna of each antenna pair configured to offset the phase based on a height difference of the two antennas of the antenna pair. By having an electromagnetic signal radiated by the four bowtie antennas configured in two antenna pairs, where the height of the two antennas of a respective antenna pair is different, a radiation patterns can be created to have a maximum at a predetermined angle. Thus, the combined system radiation pattern may have a wider range of angles over which communication my be possible compared to either antenna element by itself.

V. Computing Device and Computer Program Product

Figure 7:
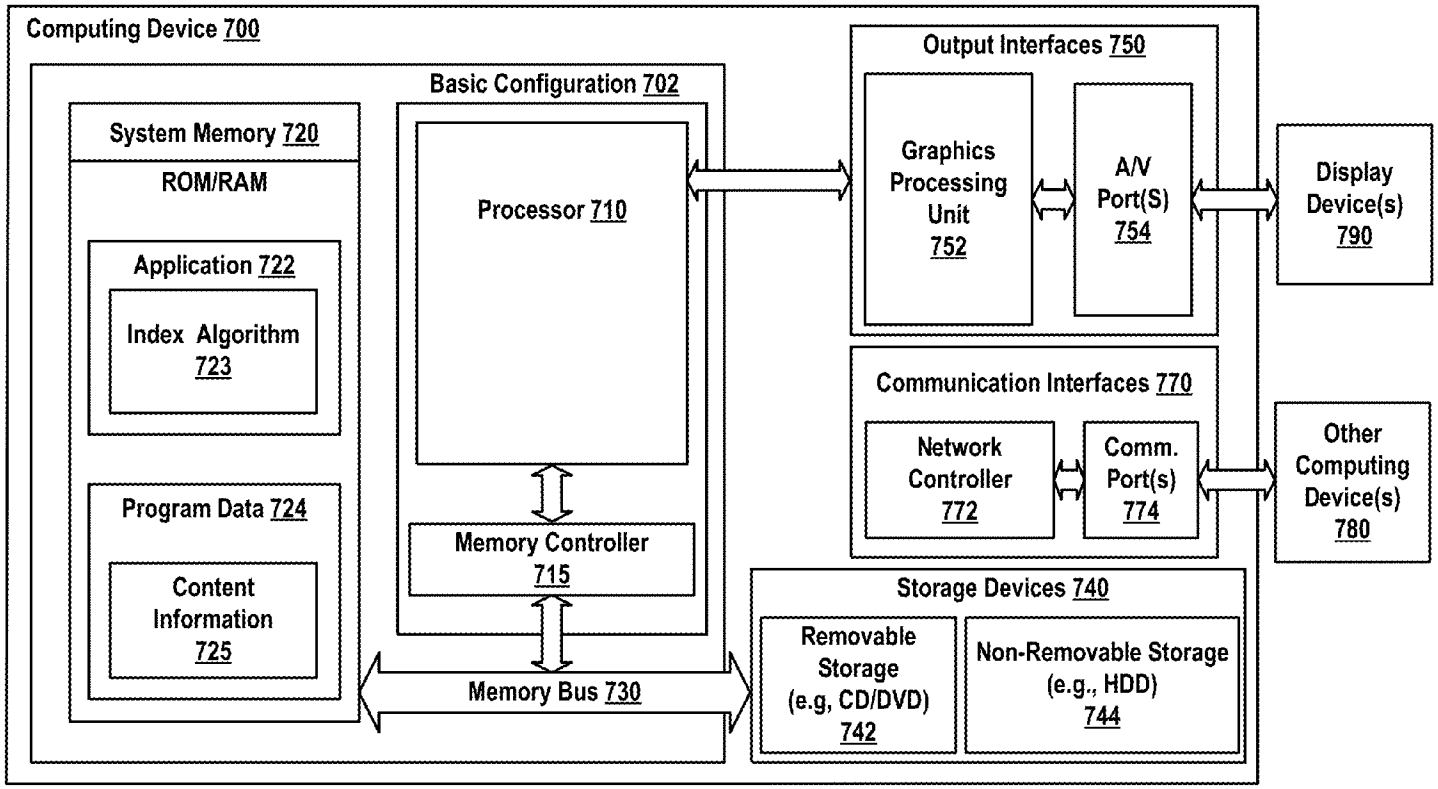
FIG. 7 illustrates a functional block diagram of a computing device, according to an embodiment.

FIG. 7 illustrates a functional block diagram of a computing device 700, according to an embodiment. The computing device 700 can be used to perform functions in connection with the operation of a balloon network. In particular, the computing device can be used to perform some or all of the functions discussed above in connection with FIGS. 1-6.

The computing device 700 can be or include various types of devices, such as, for example, a server, personal computer, mobile device, cellular phone, custom computing device, or tablet computer. In a basic configuration 702, the computing device 700 can include one or more processors 710 and system memory 720. A memory bus 730 can be used for communicating between the processor 710 and the system memory 720. Depending on the desired configuration, the processor 710 can be of any type, including a microprocessor (μP), a microcontroller (μC), or a digital signal processor (DSP), among others. A memory controller 715 can also be used with the processor 710, or in some implementations, the memory controller 715 can be an internal part of the processor 710.

Depending on the desired configuration, the system memory 720 can be of any type, including volatile memory (such as RAM) and non-volatile memory (such as ROM, flash memory). The system memory 720 can include one or more applications 722 and program data 724. The application(s) 722 can include an index algorithm 723 that is arranged to provide inputs to the electronic circuits. The program data 724 can include content information 725 that can be directed to any number of types of data. The application 722 can be arranged to operate with the program data 724 on an operating system.

The computing device 700 can have additional features or functionality, and additional interfaces to facilitate communication between the basic configuration 702 and any devices and interfaces. For example, data storage devices 740 can be provided including removable storage devices 742, non-removable storage devices 744, or both. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives. Computer storage media can include volatile and nonvolatile, non-transitory, removable and non-removable media implemented in any method or technology for storage of information, such as computer readable instructions, data structures, program modules, or other data.

The system memory 720 and the storage devices 740 are examples of computer storage media. Computer storage media includes, but is not limited to, RAM, ROM, EEPROM, flash memory or other memory technology, CD-ROM, DVDs or other optical storage, magnetic cassettes, magnetic tape, magnetic disk storage or other magnetic storage devices, or any other medium that can be used to store the desired information and that can be accessed by the computing device 700.

The computing device 700 can also include output interfaces 750 that can include a graphics processing unit 752, which can be configured to communicate with various external devices, such as display devices 790 or speakers by way of one or more A/V ports or a communication interface 770. The communication interface 770 can include a network controller 772, which can be arranged to facilitate communication with one or more other computing devices 780 over a network communication by way of one or more communication ports 774. The communication connection is one example of a communication media. Communication media can be embodied by computer-readable instructions, data structures, program modules, or other data in a modulated data signal, such as a carrier wave or other transport mechanism, and includes any information delivery media. A modulated data signal can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR), and other wireless media.

The computing device 700 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. The computing device 700 can also be implemented as a personal computer including both laptop computer and non-laptop computer configurations.

Figure 8:
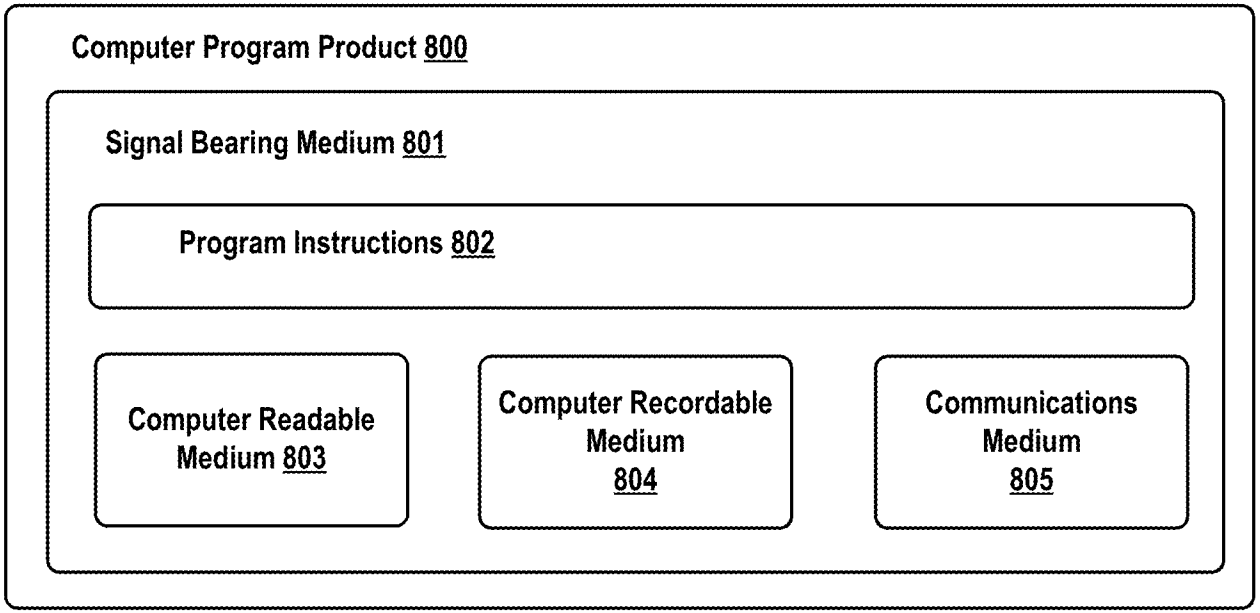
FIG. 8 illustrates a computer program product, according to an embodiment.

The disclosed methods can be implemented as computer program instructions encoded on a non-transitory computer-readable storage medium in a machine-readable format, or on other non-transitory media or articles of manufacture. FIG. 8 illustrates a computer program product 800, according to an embodiment. The computer program product 800 includes a computer program for executing a computer process on a computing device, arranged according to some disclosed implementations.

The computer program product 800 is provided using a signal bearing medium 801. The signal bearing medium 801 can include one or more programming instructions 802 that, when executed by one or more processors, can provide functionality or portions of the functionality discussed above in connection with FIGS. 1-6. In some implementations, the signal bearing medium 801 can encompass a computer-readable medium 803 such as, but not limited to, a hard disk drive, a CD, a DVD, a digital tape, or memory. In some implementations, the signal bearing medium 801 can encompass a computer-recordable medium 804 such as, but not limited to, memory, read/write (R/W) CDs, or R/W DVDs. In some implementations, the signal bearing medium 801 can encompass a communications medium 805 such as, but not limited to, a digital or analog communication medium (for example, a fiber optic cable, a waveguide, a wired communications link, or a wireless communication link) Thus, for example, the signal bearing medium 801 can be conveyed by a wireless form of the communications medium 805 (for example, a wireless communications medium conforming with the IEEE 802.11 standard or other transmission protocol).

The one or more programming instructions 802 can be, for example, computer executable instructions. A computing device (such as the computing device 700 of FIG. 7) can be configured to provide various operations in response to the programming instructions 802 conveyed to the computing device by one or more of the computer-readable medium 803, the computer recordable medium 804, and the communications medium 805.

While various examples have been disclosed, other examples will be apparent to those skilled in the art. The disclosed examples are for purposes of illustration and are not intended to be limiting, with the true scope and spirit being indicated by the following claims.

What is claimed is:

1. An antenna system comprising:

a first set of radiating elements configured (i) to emit electromagnetic radiation corresponding to an input signal and (ii) having have a first polarization, wherein the first set comprises:

a first radiating element having a first height;

a second radiating element having a second height, wherein the second radiating element is coupled to a first phase adjustment component, and a second set of radiating elements configured (i) to emit electromagnetic radiation corresponding to the input signal and (ii) having a second polarization that is substantially perpendicular to the first polarization, wherein the second set comprises:

a third radiating element having a third height; and a fourth radiating element having a fourth height, wherein the fourth radiating element is coupled to a second phase adjustment component, and a reflecting element configured to reflect at least a portion of the electromagnetic radiation emitted by the radiating elements; and a feed configured to provide the input signal.

2. The antenna system according to claim 1, wherein each radiating element is a bowtie antenna.

3. The antenna system according to claim 2, wherein each bowtie is configured with an antenna axis parallel to the reflecting element.

4. The antenna system according to claim 3, wherein the system radiation pattern is configured to have maximums at ±60 degrees from a normal direction to a plane of the reflecting element.

5. The antenna system according to claim 4, wherein a difference between the first height and the second height is set to have maximums at ±60 degrees from a normal direction to a plane of the reflecting element.

6. The antenna system according to claim 1, wherein a phase adjustment provided by the phase adjustment component is based on a difference between the first height and the second height, wherein the phase adjustment offsets for the difference.

7. The antenna system according to claim 1, wherein the antenna system has greater than 30% bandwidth.

8. The antenna system according to claim 1, wherein the height of each radiating element is measured from the reflecting element.

9. A method of radiating electromagnetic energy comprising:

feeding a first input signal to a signal divider configured to divide the signal into four feed signals;

offsetting the phase of a first signal of the four feed signals with a first phase offset;

offsetting the phase of a second signal of the four feed signals with a second phase offset;

radiating the first signal of the four feed signals with a first radiating element, wherein a first radiated signal has a first polarization and a first phase;

radiating the second signal of the four feed signals with a second radiating element, wherein a second radiated signal has a second polarization and a second phase and wherein the second polarization is substantially perpendicular to the first polarization;

radiating a third signal of the four feed signals with a third radiating element, wherein a third radiated signal has the first polarization and a third phase;

radiating a fourth signal of the four feed signals with a fourth radiating element, wherein a fourth radiated signal has the second polarization and a fourth phase; and reflecting at least a portion of the electromagnetic radiation emitted by the radiating elements via a reflecting element.

10. The method according to claim 9, wherein each radiating element is a bowtie antenna.

11. The method according to claim 9, wherein each polarization is substantially parallel to a plane of the reflecting element.

12. The method according to claim 9, wherein a system radiation pattern is configured to have maximums at ±60 degrees from a normal direction to a plane of the reflecting element.

13. The method according to claim 9, wherein the first phase and the second phase are equal and wherein the third phase and fourth phase are equal.

14. The method according to claim 13, wherein a difference between the first phase and the second phase is set to create a system radiation pattern having maximums at ±60 degrees from a normal direction to a plane of the reflecting element.

15. The method according to claim 9, wherein a difference between the first phase and the second phase is based on a difference between the first phase and the third phase.

16. The method according to claim 9, wherein each radiating element has greater than 30% bandwidth.

17. An antenna system comprising:

a first set of radiating elements configured (i) to emit electromagnetic radiation corresponding to an input signal and (ii) having a first height, wherein the first set comprises:

a first radiating element having a first polarization;

a second radiating element having a second polarization, wherein the second polarization is substantially perpendicular to the first polarization, and a second set of radiating elements configured (i) to emit electromagnetic radiation corresponding to the input signal and (ii) having a second height, wherein each radiating element of the second set is coupled to a respective phase adjustment component, and wherein the second set comprises:

a third radiating element having a third polarization; and a fourth radiating element having a fourth polarization, wherein the third polarization is substantially perpendicular to the fourth polarization, and a reflecting element configured to reflect at least a portion of the electromagnetic radiation emitted by the radiating elements; and a feed configured to provide the input signal.

18. The antenna system according to claim 17, wherein:

the first polarization and the third polarization are substantially parallel; and the third polarization and the fourth polarization are substantially parallel.

19. The antenna system according to claim 17, wherein a phase adjustment provided by the phase adjustment component is based on a difference between the first height and the second height, wherein the phase adjustment offsets for the difference.

20. The antenna system according to claim 17, further comprising a fifth radiating element, wherein the fifth radiating element has a polarization substantially perpendicular to both the first polarization and the third polarization.

* * * * *